United States Patent [19]

Polan

[11] Patent Number: 4,991,656

[45] Date of Patent: Feb. 12, 1991

[54] QUICK RELEASE VALVE FOR SPRINKLER HEAD

[75] Inventor: George S. Polan, Harleysville, Pa.

[73] Assignee: Central Sprinkler Corporation, Lansdale, Pa.

[21] Appl. No.: 502,462

[22] Filed: Mar. 30, 1990

Related U.S. Application Data

[63] Continuation-in-part of Ser. No. 357,389, May 25, 1989, abandoned.

[51] Int. Cl.[5] ..... A62C 37/14

[52] U.S. Cl. ..... 169/38

[58] Field of Search ..... 169/38, 39, 37, 40, 169/41, 19

[56] References Cited

U.S. PATENT DOCUMENTS

| | | | |
|---|---|---|---|
| H121 | 9/1986 | Pieczykolan . | |
| 585,130 | 6/1897 | Steck . | |
| 1,797,919 | 3/1931 | Loepsinger . | |
| 3,874,455 | 4/1975 | Klesow | 169/19 |
| 4,121,665 | 10/1978 | Woycheese | 169/38 |
| 4,167,974 | 9/1979 | Job | 169/38 |
| 4,609,047 | 9/1986 | Pieczykolan | 169/38 |
| 4,648,459 | 3/1987 | Pieczykolan | 169/38 |
| 4,830,115 | 5/1989 | Polan | 169/38 |
| 4,901,799 | 2/1990 | Pepi et al. | 169/38 |

*Primary Examiner*—Sherman Basinger
*Assistant Examiner*—Stephen P. Avila
*Attorney, Agent, or Firm*—Panitch Schwarze Jacobs & Nadel

[57] ABSTRACT

In a quick release valve for a sprinkler head, a valve seat includes an annular stop member spaced outwardly from a fluid passage outlet having an annular beveled surface spaced outwardly from the outlet. A sealing member is seated in the valve seat. A resiliently flexible valve disk has a peripheral flange portion which is turned over the sealing member and rests against the beveled surface. The beveled surface prevents outward radial movement of the peripheral flange portion. A rigid, frangible, thermal, responsive element resiliently deflects the valve disk so as to compress the sealing member and seal the outlet.

13 Claims, 4 Drawing Sheets

FIG. 4
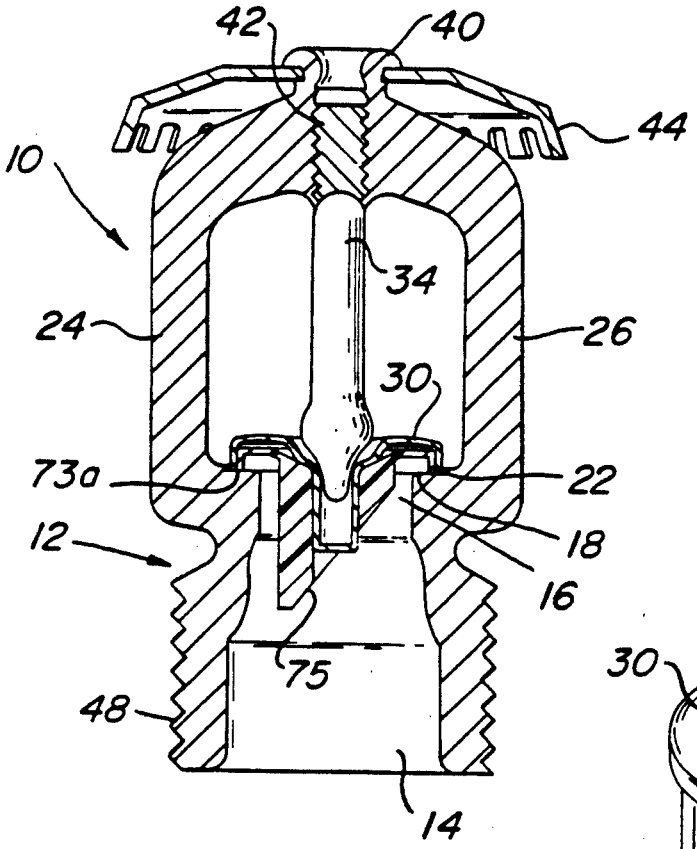
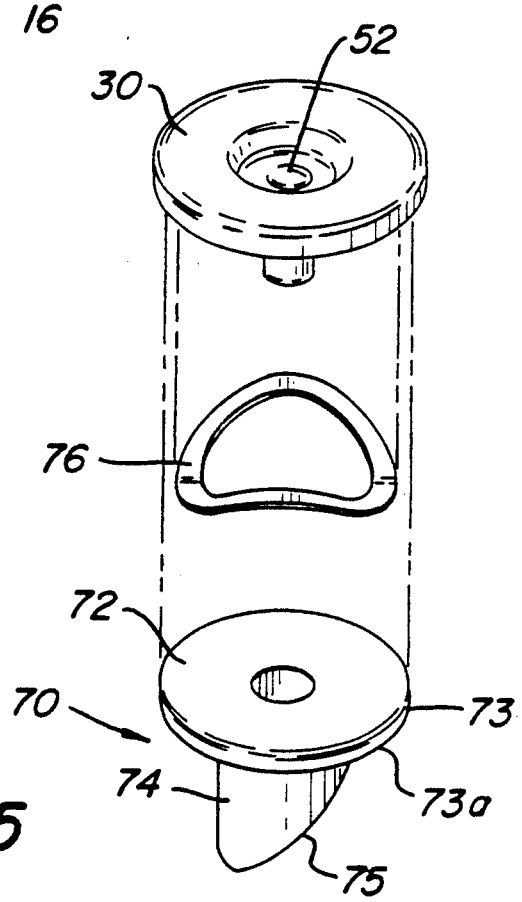
FIG. 5

FIG. 6
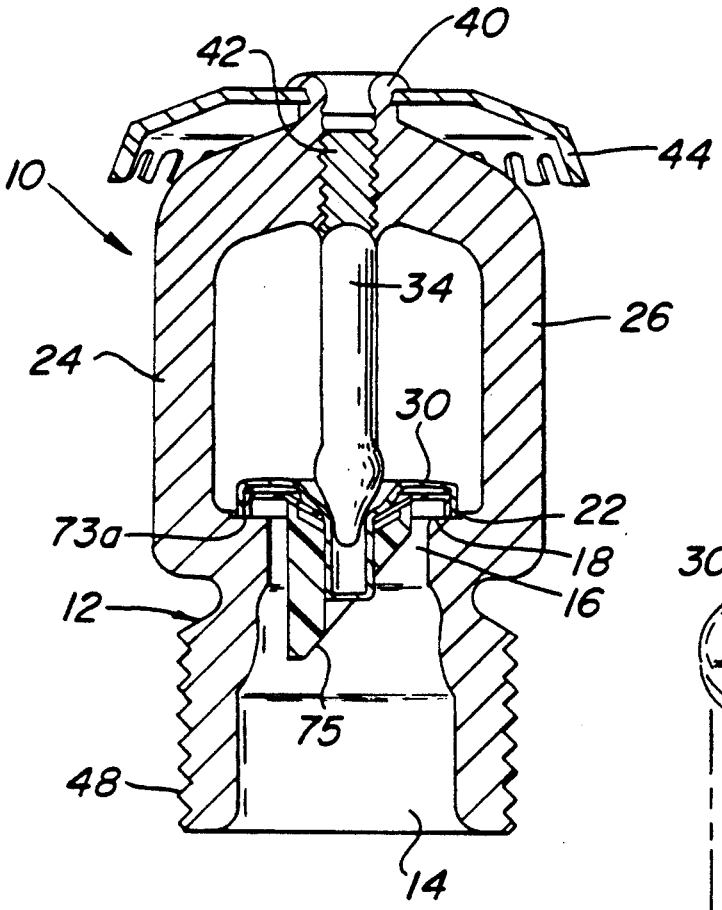
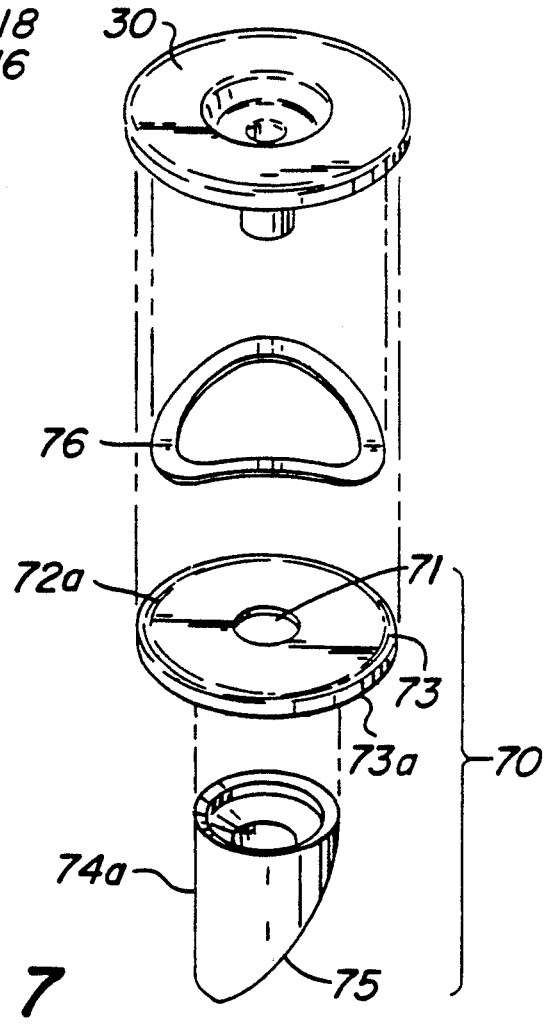
FIG. 7

QUICK RELEASE VALVE FOR SPRINKLER HEAD

RELATED APPLICATION

This is a continuation-in-part application of U.S. patent application Ser. No. 357,389, filed May 25, 1989, now abandoned.

FIELD OF THE INVENTION

The invention is related to automatic sprinklers and, in particular, to a quick release valve of simplified construction for a sprinkler head for such an automatic sprinkler.

BACKGROUND OF THE INVENTION

U.S. Statutory Invention Disclosure H121 discloses various embodiments for a quick release valve for a sprinkler head. Each embodiment includes a sprinkler body defining a flow passage for conducting a fire retarding fluid to an outlet of the body and a valve seat on the body at the outlet. In each case, the valve includes a substantially rigid seal cap, an O-ring positioned between the seal cap and the valve body for maintaining a seal, and a spring washer. The spring washer centrally receives the head of a thermally responsive frangible element, in particular a glass bulb. The glass bulb is substantially rigid and is loaded in compression against the flexible washer by means of an adjustment screw substantially rigidly supported by a pair of yoke arms extending from the sprinkler body. The spring washer reduces the compressive preload required to protect the frangible element during normal operation. As a result, lighter and thinner walled frangible elements may be employed so as to provide a quicker response or triggering action at the selected threshold temperature, all without compromising the frangible element or the valve seat.

SUMMARY OF THE INVENTION

The present invention is a quick release sprinkler. The sprinkler comprises a sprinkler body defining a flow passage for conducting a fire retarding fluid to an outlet and a valve seat on an end face of the body around the outlet. The valve seat includes stop means extending from the end face and spaced radially outwardly from the outlet. The sprinkler further includes a sealing member seated in the valve seat. The sealing member is spaced at least partially outwardly from the outlet. A resiliently flexible valve disk is provided for obstructing the flow of fluid through the outlet. The valve disk has a peripheral flange portion which turns over the sealing member towards the sprinkler body and rests against the stop means such that the stop means prevents outward radial movement of the peripheral flange portion of the disk. The sprinkler further comprises a substantially rigid, frangible, thermal responsive element received centrally on the valve disk opposite the flow passage. Loading means are provided for adjustably loading the frangible element under compression against the valve disk such that the valve disk resiliently deflects without outward radial movement of the peripheral flange portion to compress the sealing member and seal the outlet.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, there is shown in the drawing an embodiment which is presently preferred. It is to be understood, however, that the invention is not limited to the precise arrangements and instrumentality shown. In the drawings:

FIG. 4 is a partial cross-sectional view of another embodiment of a sprinkler head in accordance with the present invention;

FIG. 5 is an exploded view of the sealing member of FIG. 4;

FIG. 6 is a partial cross-sectional view of still another embodiment of a sprinkler head in accordance with the present invention; and FIG. 7 is an exploded view of the sealing member of FIG. 6.

DETAILED DESCRIPTION OF THE PREFERRED EMBODIMENTS

Figure 1:
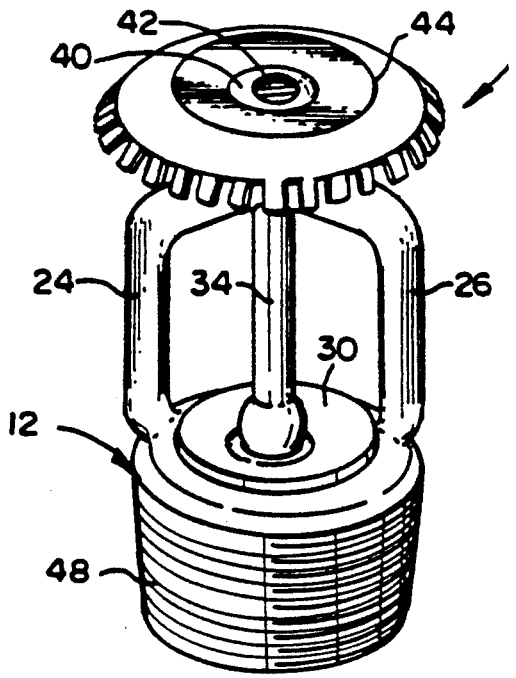
FIG. 1 is a perspective view of a sprinkler head in accordance with the present invention.

In the drawings, wherein like numerals are used to indicate like elements, there is shown presently preferred embodiments of the quick release sprinkler of the invention designated generally at 10. The sprinkler 10 includes a body 12 integrally supporting a pair of arms 24 and 26 joined at a collar portion 40 which threadingly receives an adjustment member in the form of a set screw 42. The set screw 42 holds and compressively loads a rigid, frangible, thermal responsive element, preferably in the form of a glass bulb 34, against a valve disk or "saddle" 30.

External threads 48 are provided at an inlet end of the sprinkler body 12 for connecting that end of the sprinkler body to a pressurized fluid conduit (not depicted), in a manner well known in the art. The fluid conduit provides a pressurized, fire-retarding fluid, typically water, to the sprinkler body. The fluid passes through the body 12 when the valve disk 30 is released by breakage of the glass bulb 34. A deflector 44 is supported in a conventional manner at the collar 40 to deflect the fluid outwardly as it passes through the sprinkler body.

Figure 2:
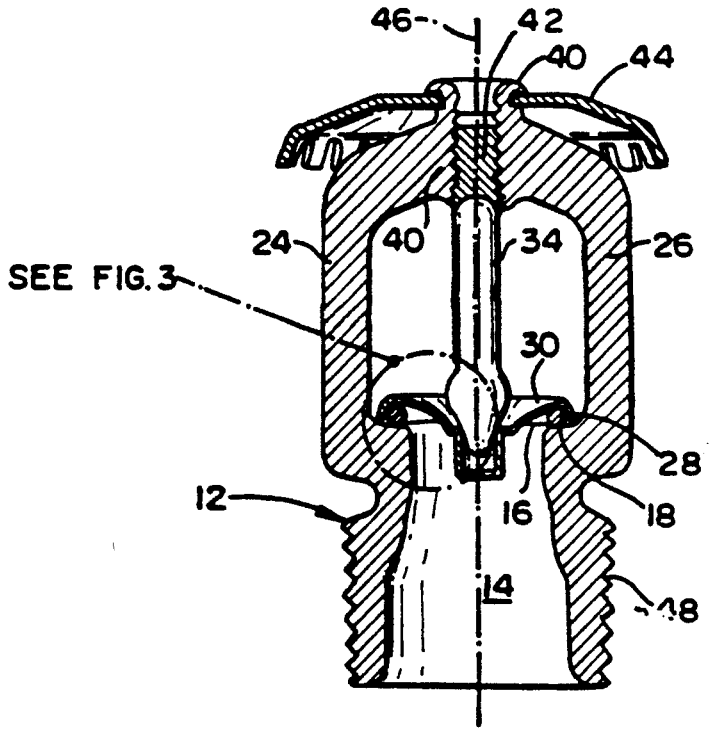
FIG. 2 is a partial cross-sectional view of the sprinkler head of FIG. 1.

Referring to FIG. 2, the body 12 defines a flow passage 14 for conducting the fire retarding fluid to an outlet 16 on the body 12. A valve seat, indicated generally at 18 in FIGS. 2 and 3, is provided on the annular end face of sprinkler body 12 around the outlet 16.

Figure 3:
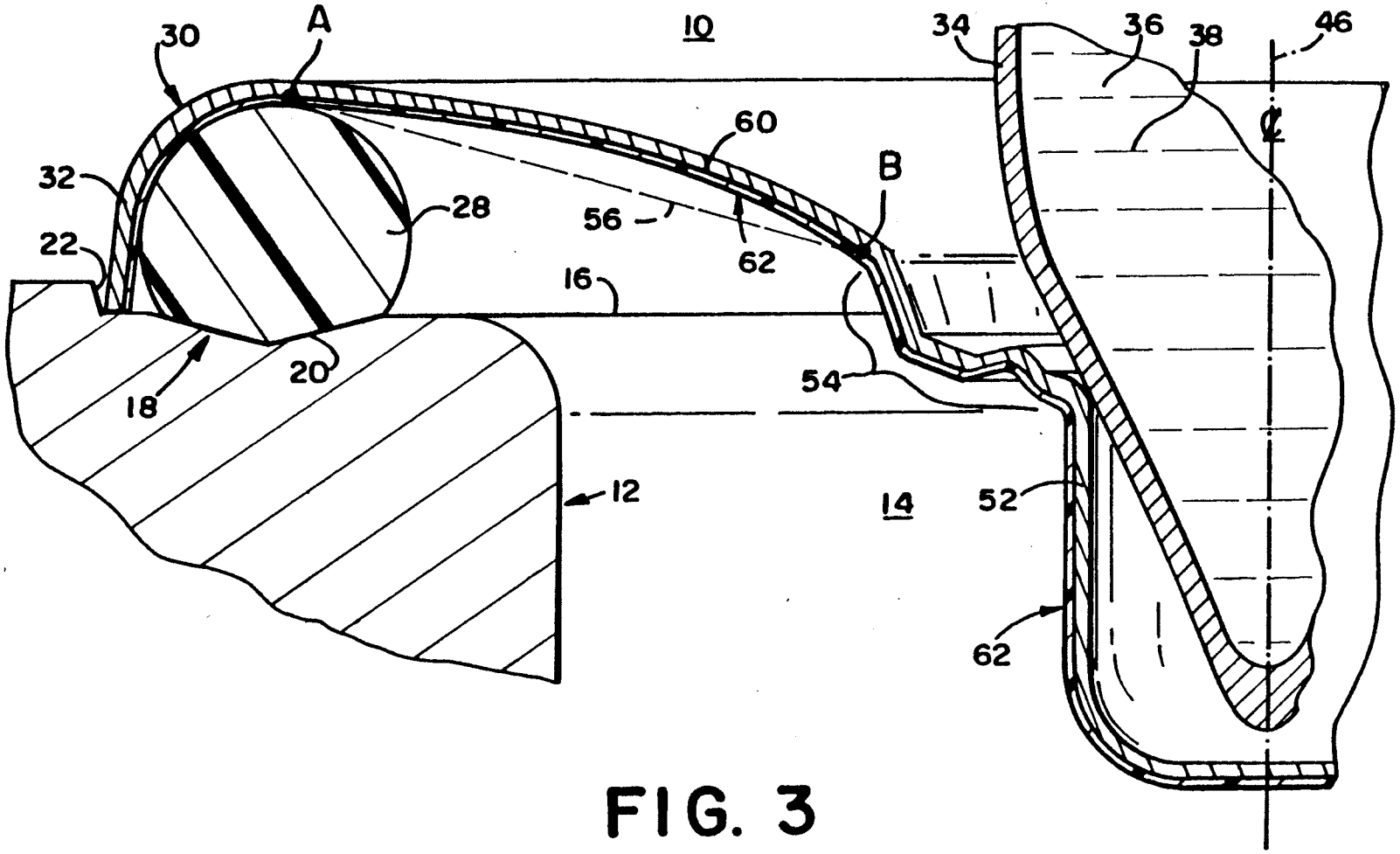
FIG. 3 is a detail of the area of the sprinkler head circled in FIG. 2.

As is best seen in FIGS. 3 and 4, the valve seat 18 includes stop means, preferably in the form of an annular shoulder having a beveled annular surface 22. Annular surface 22 is spaced radially outwardly from the outlet 16. The beveled surface 22 extends from the end face towards arms 24 and 26 (see FIGS. 1, 2 and 4), whereby the radius of the surface 22 proximate the end face is slightly less than the radius of the beveled surface distal to the end face, as shown in FIG. 3.

As best seen in FIG. 3, a sealing member is seated in the valve seat 18. The resiliently flexible valve disk 30 rests on the sealing member and extends over the outlet 16. The valve disk 30 includes a preferably smooth, peripheral flange portion 32 turned over the sealing member towards the valve seat 18. The peripheral flange portion 32 extends between the stop means beveled surface 22 and the sealing member, resting against the beveled surface 22. The beveled surface 22 prevents outward radial movement of the turned peripheral flange portion 32 of the valve disk 30 in a manner to be described.

Preferably, the sealing member comprises an O-ring 28, as illustrated in FIGS. 1 through 3 or a seal assembly 70, as illustrated in FIGS. 4 through 7. The O-ring 28 is preferably formed of a standard sealing material such as silicone and, further, is preferably coated with a friction reducing material, such as tetrafluoroethylene, for example, a TEFLON® coated EPDM O-ring, to minimize friction and sticking between the valve disk 30 and the O-ring 28 and between the O-ring 28 and the valve seat 18. Also, preferably, one side 60 of the valve disk 30, facing the O-ring 28, is coated with a layer 62 of friction reducing material such as tetrafluoroethylene to further reduce sticking between the disk 30 and O-ring 28. The tetrafluoroethylene layer 62 further provides a degree of protection from corrosion for the valve disk 30.

Where the sealing member comprises an O-ring 28, it is preferred that the valve seat 18 includes an annular groove 20, preferably V-shaped, surrounding the outlet 16 as illustrated in FIG. 3. Preferably, the diameter of the O-ring 28 is substantially equal to the diameter of the annular groove 20. Preferably also, the O-ring should be compressed approximately thirty percent by valve disk 30 when seated in the groove 20.

It is presently preferred in accordance with the present invention that the sealing member comprises a seal assembly 70 as illustrated by the embodiment of FIGS. 4 through 7. The seal assembly 70 is a one or two-piece assembly which may be inserted or removed from the sprinkler body 12 as a modular unit. In the one piece assembly, best illustrated in FIG. 5, the seal assembly 70 comprises a sealing disk end 72 and a bushing end 74. In the two piece assembly best illustrated in FIG. 7, the seal assembly 70 comprises a sealing disk 72*a* and a separate bushing 74*a* which is removably securable to the sealing disk 72*a* to form a seal assembly which, when assembled, is substantially the same as the seal assembly 70 of FIG. 5.

The seal assembly 70 is preferably formed of a non-corrosive, resilient, polymeric material, such as TEFLON® or NYLON®, although it will appreciated by one skilled in the art that other materials may be used. The choice of materials depends, in part, on the particular end use and the cost involved. However, for proper operation of the sprinkler 10 the material should exhibit an ability to minimize friction and sticking between the valve disk 30 and the seal assembly 70 and between the seal assembly 70 and the valve seat 18. In addition, the material should be capable of achieving seal integrity at various fluid pressures and still be capable of minimizing any adhesion which may occur between the components over a period of years while installed in an active sprinkler.

The seal assembly 70 may be machined or molded using conventional techniques and apparatus. Preferably, the bushing end 74 or bushing 74*a* is generally cylindrical in shape and has an aperture 75 partially therethrough having an inner diameter for receiving a recessed portion 52 of the valve disk 30 so as to form a friction fit between the bushing end 74 or bushing 74*a* and the valve disk 30 to firmly hold the sealing disk end 72 or sealing disk 72*a* therebetween. The outer diameter of the bushing end 74 or bushing 74*a* should be smaller than the inner diameter of the sprinkler outlet 16 and flow passage 14 so that the bushing end 74 or bushing 74*a* may be freely inserted and removed from the sprinkler outlet 16. The length of the bushing end 74 or bushing 74*a* may be determined by one skilled in the art in view of this disclosure, but should assist in the assembly of the sprinkler and should allow the free and complete release of the valve disk 30 and the seal assembly 70 when the sprinkler 10 is actuated.

Preferably, the sealing disk end 72 or sealing disk 72*a* should be thin enough to be resiliently flexible and has an aperture 71 therethrough for receiving a recessed portion 52 of the valve disk 30. In addition, the sealing disk end 72 or sealing disk 72*a* includes a preferably smooth, peripheral flanged portion 73, the radial outer surface of which substantially completely engages the surface defined by the inner diameter of the flange portion 32 of the valve disk 30 when the disk end 72 or sealing disk 72*a* is inserted into the valve disk 30, as shown in FIGS. 4 and 6. The peripheral edge 73*a* of the sealing disk end 72 or sealing disk 72*a* is substantially completely engageable with the valve seat 18 to form a liquid tight seal with the valve seat 18. It will be understood in view of FIGS. 4 and 6 that the peripheral edge 73*a* of the sealing disk end 72 or sealing disk 72*a* engages the valve 18 at a position spaced radially outwardly from the outlet 16. Further, one skilled in the art will appreciate in view of this disclosure that the total surface area of contact between the peripheral edge 73*a* and the valve seat 18 is relatively small, thereby minimizing the possibility of the seal assembly sticking to the valve seat 18.

In accordance with the present invention, it may desired to interpose biasing means 76 between the valve disk 30 and the seal assembly 70 (FIGS. 5 and 7) to facilitate quick release of the valve disk 30 from the sprinkler body 12. Preferably, the biasing means 76 provides a biasing moment or springback of about 0.030 inch. It is presently preferred to employ a wave type spring as the biasing means 76, although one skilled in the art will appreciate that other suitable biasing means may be used.

Further, it may be desired in accordance with the present invention to angle or taper the distal end 75 of the bushing end 74 or bushing 74*a* distal the sealing disk end 72 or sealing disk 72*a* as best shown in FIGS. 4 and 6. It will be understood by one skilled in the art in view of the present disclosure that fluid pressure and flow on the angled end 75 will cause a tumbling or rolling effect of the valve disk 30/seal assembly 70 to further facilitate quick release of the valve disk 30 and seal assembly 70 and clearance from the sprinkler body 12. An angle of about 50° is presently preferred, although greater and lesser angles may be used.

Referring to FIGS. 3 and 4, the glass bulb 34 is received in a recess or "nest" 52, which is formed at the center of the valve disk 30 and extends into the flow passage 14. The glass bulb 34 is provided with an internal chamber 36 which contains a fluid 38, such as an alcohol, which expands with increasing temperatures to fracture the bulb 34 and thereby trigger or activate the sprinkler 10.

The bulb 34 is substantially rigid in comparison with the valve disk 30. The arms 24 and 26, collar 40 and set screw 42 are also substantially rigid in comparison with the valve disk 30 and collectively constitute means for adjustably loading the frangible glass bulb 34 under compression against the valve disk 30. The valve disk 30 resiliently deflects under the compressive loading of the glass bulb 34 to compress the sealing member (28 or 70) and seal the outlet 16.

Preferably, the various components of the sprinkler 10 are symmetric with respect to a center line 46 of the sprinkler 10 for uniform loading of the valve disk 30 and uniform compression of the sealing member.

Preferably, the valve disk 30 is stamped from a corrosion-resistant material, such as a phosphor bronze No. C524 alloy or stainless steel, and is no more than about 0.02 inches thick to be resiliently flexible and to impart a spring-like action to the disk 30. An annular stiffening rib 54 is formed in the valve disk 30, surrounding and adjoining the recess 52. The rib 54 assures a high level of rigidity in the disk around the recess 52 and transmits deflective forces induced by the set screw 42 and glass bulb 34 to a designated, annular flex zone concentrically surrounding the stiffening rib 54 and extending approximately between the stiffening rib 54 and the beginning of the peripheral flange portion 32, and to the peripheral flange portion 32, whereby the outer surface of the peripheral flange portion 32 extends essentially axially. The radial extent of the annular flex zone is indicated by broken line 56 in FIG. 3 extending between points "A" and "B".

By way of exemplary dimensions, the flow passage 14 may be about 0.440 inch in diameter at the outlet 16 while the valve disk 30 may have a diameter of approximately 0.750 inch. Where desired, the depth of the annular groove 20 is a small fraction of the transverse cross-sectional diameter of the O-ring 28 or the flange portion 73 of the seal assembly 70, for example, about one-eighth of that diameter.

Several advantages over the prior art are achieved by the present invention. First, sealing of the outlet end of the sprinkler body 12 is accomplished with only two elements, the sealing member and the valve disk 30. Also, these are the only elements, apart from the sprinkler body 12, which are exposed to the pressurized fluid in the flow passage 14.

Where the sealing member comprises an O-ring 28, the annular groove 20 and the O-ring 28 are spaced sufficiently radially outwardly from the outlet 16 so that the O-ring 28 does not interfere with the flow of fluid through the outlet, even if the O-ring 28 were to become stuck to the valve seat 18 under long-term compressive loads. If desired, a suitable grease or some other type of lubricant can be provided between the O-ring 28 or seal assembly 70 and the surface of the valve seat 18 or the groove 20 to further retard sticking of the O-ring 28 or seal assembly 70 to the sprinkler body 12.

The beveled annular surface 22 provides means for initially locating the sealing member and the groove 20 provides means for initially locating and seating the O-ring 28, in particular. In this way, the surface 22 and groove 20 facilitate the rapid and even automated assembly of the sprinkler 10. The concentrically positioned sealing member and beveled surface 22 further provide means for concentrically positioning the valve disk 30 for rapid and/or automated assembly of the sprinkler 10. Concentric positioning of the seal elements, namely the sealing member and valve disk 30, with respect to the outlet 16 and the bulb 34 further assures uniform loading on both seal elements for optimal, uniform sealing around the outlet 16.

Similarly, the bushing end 74 or bushing **74*a* into which the recess 52 of the valve disk 30 is press fit, forming a modular unit, facilitates rapid and consistent assembly of the sprinkler 10. Further, the sealing disk end 72 or sealing disk 72*a* facilitates cocentric positioning, with the valve disk 30, to assure uniform loading on the seal elements, namely the seal assembly 70 and the valve disk 30, for optimal, uniform sealing around the outlet 16**.

The beveling of the surface 22 combined with the essentially axially extending (vertical in FIG. 3) outer surface of the peripheral flange portion 32, which when installed, abuts the beveled surface 22, further minimizes the build up of deposits between the beveled surface 22 and the peripheral flange portion 32. It also subjects any deposits which may tend to form on the disk 30 along the flange portion 32 to shear forces when the valve disk 30 is released. Shear forces are less easily resisted by the types of deposits conventionally formed in such devices than are axial (compressive or tensile) forces typically found in conventional devices.

The disk 30 should preferably be sized so as to just contact the beveled surface 22 when the valve disk 30 is initially placed over the sealing member. When the valve disk 30 is compressively loaded through the frangible glass bulb 34, there is a tendency of the peripheral flange portion 32 of the disk 30 to move radially outwardly if unrestrained. This tendency is prevented by contact with the beveled surface 22. When the compressive load is removed, for example, by fracturing of the glass bulb 34, the central portion of the valve disk 30 tends to be sprung outwardly from the outlet 16 and the sprinkler body 12, by deflection along flex zone due to the radially inward compressive force exerted along the peripheral edge portion 32 by the beveled surface 22.

The construction thus fosters rapid and complete release of the valve disk 30 from the sprinkler body 12. The valve disk 30 is deflectable in an axial but not a radial direction. The valve disk 30 and sealing member act as a shock absorber to cushion the frangible element 34. Under surge conditions, the flex zone of the valve disk may be deflected axially upwardly from the outlet 16. The sealing member is subjected to the same pressurized fluid and would deform or elongate in an axial direction to maintain the seal.

Compressive preload on the order of about sixty-five to ninety-five pounds on the valve disk 30 permits the valve disk 30 to deflect so as to protect the glass bulb 34 and maintain the outlet 16 sealed over the normal range of fluid pressures to be encountered during use. These include long-term, ambient fluid pressures of up to about one hundred seventy-five psi and surge fluid pressures of up to about two-hundred and fifty psi. This compares with typical compressive preload forces of about 100 or more pounds disclosed in the aforesaid U.S. Statutory Invention Registration H121, and the U.S. Pat. No. 4,167,974 cited therein, both incorporated herein by reference, for prior art rigid sprinkler valve assemblies. Thus, the present invention maintains the beneficial reduction in preload of the invention of the aforesaid Statutory Invention Registration H121, while reducing the number of sealing components necessary for sealing and simplifying assembly of the sprinkler 10.

The present invention may be embodied in other specific forms without departing from the spirit or essential attributes thereof. Accordingly, reference should be made to the appended claims, rather than to the foregoing specification, as indicating the scope of the invention.

I claim:

1. A quick release sprinkler comprising:

a sprinkler body defining a flow passage for conducting a fire retarding fluid to an outlet;

a valve seat formed on an end face of the sprinkler body around the outlet, the valve seat including stop means extending from the end face and spaced radially outwardly from the outlet;

a sealing member seated on the valve seat, at least a portion of the sealing member being spaced radially outwardly from the outlet;

a resiliently flexible valve disk for obstructing the flow of fluid through the outlet, the valve disk having a peripheral flange portion turned over the sealing member towards the sprinkler body and resting against the stop means such that the stop means prevents outward radial movement of the peripheral flange portion of the valve disk;

a substantially rigid, frangible, thermal responsive element received centrally on the valve disk opposite the flow passage; and loading means for adjustably loading the frangible element under compression against the valve disk such that the valve disk resiliently deflects, without outward radial movement of the peripheral flange portion, to compress the sealing member against the valve seat to seal the outlet.

2. The quick release sprinkler of claim 1, further comprising an annular groove extending into the valve seat spaced outwardly from the outlet.

3. The sprinkler head of claim 2, wherein the cross-section of the annular groove is substantially V-shaped.

4. The sprinkler head of claim 2, wherein the sealing member comprises an O-ring.

5. The sprinkler head of claim 4, further comprising a friction reducing layer on a side of the valve disk contacting the O-ring.

6. The sprinkler head of claim 4, wherein the outlet is entirely sealed by the O-ring, the valve disk and the valve seat.

7. The sprinkler head of claim 4, wherein the annular groove, the O-ring and the annular disk are all symmetric with respect to a central axis of the outlet for uniform compression of the O-ring by the valve disk.

8. The sprinkler head of claim 1, wherein the valve disk includes a recessed, centrally located nest for receiving the frangible element and a stiffening rib surrounding the nest for transferring compressive loading from the frangible element on the valve disk to a flex zone portion of the valve disk radially surrounding the stiffening rib.

9. The sprinkler head of claim 8, wherein the sealing member comprises a seal assembly having a sealing disk portion and a bushing portion, the sealing disk portion being a resiliently flexible disk having a peripheral flange portion for engaging said valve seat to seal the outlet, the sealing disk further being complemental in shape for engaging the valve disk, said bushing portion being substantially cylindrical and having an aperture extending partially therethrough for at least partially receiving the recessed, centrally located nest of the valve disk, the bushing portion being shaped for free insertion into and removal from the outlet.

10. The sprinkler head of claim 9, wherein the sealing disk portion is completely separable from the bushing portion of the seal assembly.

11. The sprinkler head of claim 9, further comprising biasing means interposed between the valve disk and the seal assembly.

12. The sprinkler head of claim 11, wherein the biasing means is a wave spring.

13. The sprinkler head of claim 9, wherein the bushing portion is angled relative to its central axis at an end distal to the sealing disk portion.

* * * * *